United States Patent [19]

Reaver

[11] Patent Number: 4,764,988

[45] Date of Patent: Aug. 23, 1988

[54] DETACHABLE GARMENT FASTENER ATTACHMENT FOR BRASSIERE STRAP

[76] Inventor: Phyllis E. Reaver, 240 Lake Valley Rd., Hendersonville, Tenn. 37075

[21] Appl. No.: 118,854

[22] Filed: Nov. 9, 1987

Related U.S. Application Data

[63] Continuation-in-part of Ser. No. 013,724, Feb. 9, 1987, Pat. No. 4,704,745.

[51] Int. Cl.[4] ..... A41D 27/26

[52] U.S. Cl. ..... 2/268; 2/323; 2/105

[58] Field of Search ..... 2/268, 323, 105; 450/86

[56] References Cited

U.S. PATENT DOCUMENTS

| | | | |
|---|---|---|---|
| 2,719,303 | 10/1955 | Lodenius | 2/323 X |
| 4,575,874 | 3/1986 | Johnson | 2/268 |
| 4,612,935 | 9/1986 | Greifer | 2/268 X |
| 4,704,745 | 11/1987 | Reaver | 2/268 |

*Primary Examiner*—Louis K. Rimrodt
*Assistant Examiner*—J. L. Olds
*Attorney, Agent, or Firm*—Harrington A. Lackey

[57] ABSTRACT

A fastener device including an elongated sleeve member having an elongated top fastener surface and elongated detachable side edge portions for attachment to the shoulder strap of a foundation garment, such as a brassiere, for securing the undersurface of an overlying outer garment worn over the shoulder strap to conceal the shoulder strap from view.

10 Claims, 2 Drawing Sheets

DETACHABLE GARMENT FASTENER ATTACHMENT FOR BRASSIERE STRAP

CROSS-REFERENCE TO RELATED APPLICATION

This is a continuation-in-part of U.S. patent application Ser. No. 013,724, filed Feb. 9, 1987, issuing as U.S. Pat. No. 4,704,745, on Nov. 10, 1987.

BACKGROUND OF THE INVENTION

This invention relates to a fastener device for securing an undergarment to an outer garment, and more particularly to an outer garment fastener attachment detachably secured to a shoulder strap on a foundation garment.

Heretofore, there has been a tendency of the shoulder strap of a brassiere or other foundation garment to become exposed where the outer garment includes a wide neckline or is loose-fitting, or for other reasons tends to shift laterally along the shoulder away from the neck. One solution to the above problem is for the wearer to wear a strapless brassiere.

It is also known to attach the shoulder strap to a posture-corrective strap designed to fit over the shoulder caps of the wearer in order to brace the shoulders, as disclosed in the U.S. Pat. Nos. 3,008,468 to Williams issued Nov. 14, 1961, and the 3,027,898 issued Apr. 3, 1962.

Futhermore, cooperating fastener elements including a plurality of monofilament hook elements cooperating with a plurality of monofilament loop elements, better known under the trademark "VELCRO", are well-known for a variety of fastening and attachment uses, including fastening uses for various types of garments or fabrics. However, in order for the "VELCRO" fastener elements to properly function in a conventional manner, both the hook elements and the loop elements must be employed and cooperate with each other in order to secure the two parts to which the fastener elements are connected. As a matter of fact, the advertising packages and labels for many of the "VELCRO" fastener elements include cautionary language to the effect that the fastener must be closed when not in use and during cleaning because the hook half will tend to snag on some fabrics. The obvious connotation is that such snagging is objectionable.

Applicant's co-pending U.S. Pat. No. 4,704,745 discloses a garment fastener attachment in which a fastener strip having a plurality of miniature filament hook elements is secured to the top of the shoulder strap of a foundation garment, specifically a brassiere, in a position for the hook elements to catch the fibers in the undersurface of the fabric outer garment worn on the shoulder of the wearer and overlying the shoulder strap. U.S. Pat. No. 4,704,745 discloses this garment fastener attachment as being fixed to the shoulder strap or formed as a slidable sleeve for adjustably fitting the shoulder strap.

However, in the fastener attachment disclosed in the Applicant's U.S. Pat. No. 4,704,745, the shoulder strap must be disconnected from the foundation garment in order to slip the strap through the sleeve member of the fastener attachment.

SUMMARY OF THE INVENTION

It is therefore an object of this invention to provide a fastener device which is attachable to the shoulder strap of a foundation garment, and particularly a brassiere. This fastener device is not only adapted to engage or grip the undersurface of an overlying outer garment to conceal the shoulder strap beneath the outer garment, but is also constructed as a sleeve member having detachable side edge portions to permit the fastener device to be attached or removed from the shoulder strap without detaching the shoulder strap.

The fastener device made in accordance with this invention is secured to the shoulder strap preferably by a sleeve member adapted to longitudinally and slidably receive the shoulder strap, not only for assembly and disassembly with respect to the shoulder strap, but also for positioning the fastener device upon the shoulder strap to a desired location. Preferably, the fastener device is positioned along the shoulder strap directly on top of the shoulder for corresponding engagement with the overlying outer garment.

The fastener device is preferably in the form of a fastener strip having a top surface covered with a myriad of filament hook elements, such as the hook elements of a "VELCRO" fastener. The exposed hook elements on the fastener strip are adapted to catch, grip, or snag the fibers in the undersurface of the overlying outer garment, and particularly such outer garments which have loose fibers, such as wool, jersey, and any type of knitted material.

For very smooth or "slick" materials, such as silk or nonporous cotton, the hook elements of the fastener strip may not readily attach. In such cases, a garment attachment strip having a bottom surface covered with a myriad of filament loop elements, such as the loop elements of a "VELCRO" fastener, may be secured to the undersurface of the outer garment in a position for cooperation with the hook elements in the fastener strip on the shoulder strap.

The sleeve member construction of the fastener device made in accordance with this invention may be provided with different detachable securing means either along one or both longitudinal edges of the sleeve member between the fastener strip and the retainer strip. These securing edge portions may be provided with lateral strips having opposed monofilament hooks and monofilament loops for detachable engagement. In another embodiment, one edge of the retainer strip of the sleeve member may project laterally beyond and over the top of the corresponding edge of the fastener strip for detachably securing to the monofilament hook elements on the top surface of the fastener strip. The securing strip may have monofilament loop elements for cooperation with the hook elements, or it may be made of a fibrous material which will be caught by the hook elements in the fastener strip.

Also in a preferred form of this invention, the retainer strip may be made of an elastic material, which is soft enough to be comfortable to the shoulder of the wearer and which may be pulled laterally, then upward and over the top surface of the fastener strip for connection to the monofilament hook elements.

It is also within the scope of this invention for both longitudinal edge portions of the sleeve member to be detachably secured.

DESCRIPTION OF THE PREFERRED EMBODIMENTS

Figure 1:
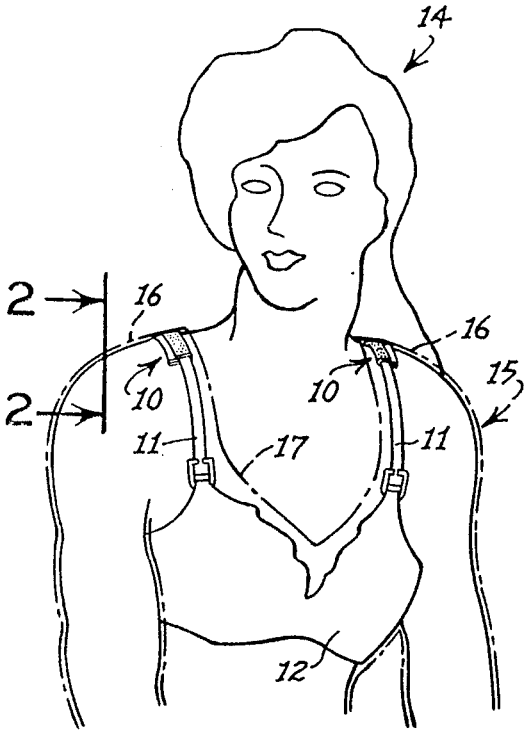
FIG. 1 is a front elevation of a woman wearing a brassiere having garment fastener attachments secured to the shoulder straps, and illustrating the neckline of an outer garment in phantom.
Figure 2:
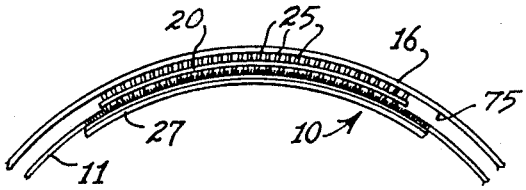
FIG. 2 is an enlarged fragmentary section taken along the line 2—2 of FIG. 1, and further illustrating the engaged outer garment portion in section.

Referring now to the drawings in more detail, FIGS. 1–5 disclose a first embodiment of the garment fastener attachment or device 10 made in accordance with this invention.

As best disclosed in FIG. 1, the garment fastener attachment 10 is mounted or assembled upon the corresponding shoulder strap 11 of a foundation garment, such as the disclosed brassiere 12, mounted upon the torso of a woman 14. An outer garment, such as the dress 15 illustrated in phantom lines in FIG. 1, is worn by the woman 14. The outer garment 15 is provided with shoulder portions 16 which extend over and cover the fastener elements 10, as well as the shoulder straps 11, and define a neckline 17.

As best illustrated in FIGS. 2–5, each fastener attachment 10 includes an elongated fastener strip 20 having a top surface 21, a bottom surface 22, and elongated parallel side edge portions 23 and 24. Projecting upwardly and formed in the top surface 21 are a plurality, or more aptly, a multitude, or myriad, of miniature filament or monofilament hook elements 25.

The fastener strip 20 is secured longitudinally on top of the shoulder strap 11, so that when the brassiere 12 is worn, the fabric strip 20 may be located on top of the shoulder of the wearer and immediately beneath, engaging and supporting, the underlying surface of the corresponding shoulder portion 16 of the outer garment 15.

The particular means for securing the fastener strip 20 to the shoulder strap 11 in FIGS. 1–5 is an elongated slider or retainer strip 27 having opposite edge portions 28 and 29 secured to the corresponding opposite edge portions 23 and 24 of the fabric strip 20 to form with the fabric strip 20 a sleeve member 26, in order to provide enough uniform cross-sectional space for longitudinally, and preferably slidably, receiving the shoulder strap 11.

Figure 3:
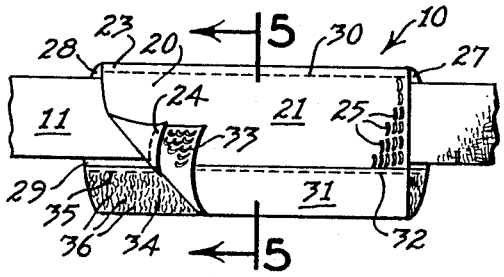
FIG. 3 is a fragmentary top plan view of the fastener strip mounted upon the shoulder strap of FIG. 2, with the corresponding portion of the outer garment removed, and with one end portion of the side securing strips detached.
Figure 4:
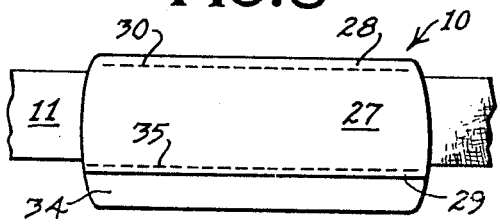
FIG. 4 is a bottom plan view of the fastener device disclosed in FIG. 3, mounted upon a shoulder strap, shown fragmentarily.
Figure 5:
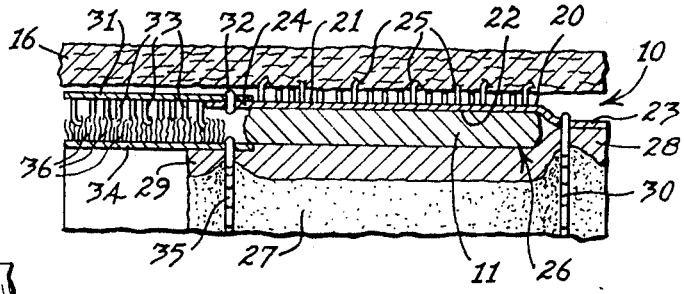
FIG. 5 is an enlarged fragmentary section taken along the line 5—5 of FIG. 3, with the overlying portion of the outer garment included.

As disclosed in FIGS. 3, 4, and 5, the opposing first side edge portions 23 and 28 of the fastener strip 20 and the retainer strip 27, respectively, are secured together by a row of elongated stitching 30, to more or less permanently secure these first side edge portions 23 and 28 together.

Secured to the longitudinal side edge portion 24 of the faastener strip 20 is an elongated securing strip 31 which projects laterally beyond the side edge portion 24, as well as beyond the corresponding side edge of the strap 11 when assembled within the fastener attachment 10. The securing strip 31 may be secured to the longitudinal side edge portion 24 by a row of stitching 32. The bottom or lower face of the securing strip 31 is covered by a plurality or multiplicity of miniature filament or monofilament hook elements 33.

Fixed to the longitudinal side edge portion 29 of the retainer strip 27 is an elongated securing strip 34 opposing the securing strip 31, and preferably being secured by the row of stitching 35 to the longitudinal side edge portion 29. The upper face of the securing strip 34 is covered by a plurality of miniature filament or monofilament loop elements 36 for detachable cooperation with the monofilament hook elements 33. The lengths and widths of the corresponding securing strips 31 and 34 are approximately the same and are wide enough to provide adequate securing surfaces between the two strips.

When it is desired to mount or assemble the fastener attachment 10 upon a shoulder strap 11, and assuming the securing strips 31 and 34 are separated, it is only necessary to insert the strap 11 laterally or sidewise between the upper fastener strip 20 and the lower retainer strip 27 until the corresponding edge of the strap 11 abuts or is adjacent the stitch line 30. The securing strips 31 and 34 are then pressed together to interlock the monofilament hooks 33 and monofilament loops 36 to secure the fastener device 10 upon the strap 11. In a preferred form of the invention, the space between the fastener strip 20 and the retainer strip 27 is slightly larger than the cross-section of the strap 11 to permit slidable movement of the fastener device 10 along the strap 11 in order to position the fastener device 10 at the proper location, mainly on top of the shoulder of the wearer 14.

When it is desired to remove the fastener device 10 from the shoulder strap 11, it is only necessary to grasp the two securing strips 31 and 34 and pull them apart to separate the interlocking hook elements 33 and loop elements 36 until the strips 31 and 34 are completely separated, whereby the device 10 is readily removed sidewise from the strap 11.

If desired, the top securing strip 31 may be removed entirely from the corresponding side edge portion 24 of the fastener strip 20. Then, the lower securing strip 34 may be wrapped around the side and the top surface 21 to permit the loops 36 to engage the hook elements 25. This structural concept is disclosed in the second embodiment of the invention disclosed in FIGS. 6–8 of the drawings.

Figure 6:
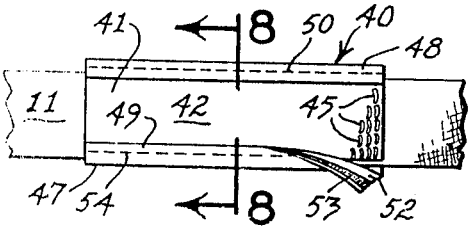
FIG. 6 is a top plan view of a second embodiment of the fastener device mounted upon a shoulder strap shown fragmentarily, with a portion of the retainer strip detached.
Figure 7:
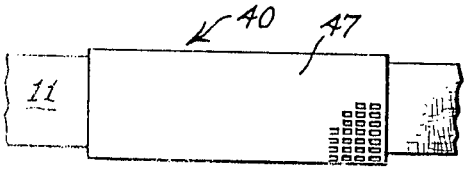
FIG. 7 is a bottom plan view of the device disclosed in FIG. 6 mounted on the shoulder strap shown fragmentarily.
Figure 8:
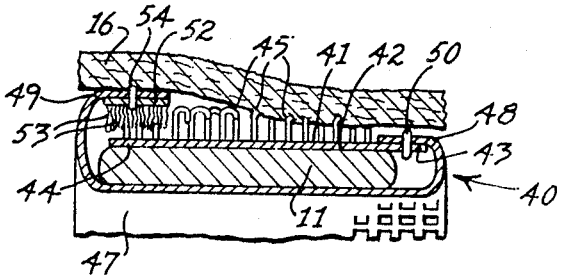
FIG. 8 is an enlarged fragmentary section taken along the line 8—8 of FIG. 6, with the overlying portion of the outer garment included.

The fastener device 40 disclosed in FIGS. 6–8 of the drawings includes an elongated fastener strip 41 having a top surface 42 and elongated parallel side edge portions 43 and 44. Projecting upwardly and formed in the top surface 42 are a plurality of miniature filament or monofilament hook elements 45.

Assembled beneath the fabric strip 41 is an elongated retainer or slider strip 47 having opposite side edge portions 48 and 49. The elongated side edge portion 48 is permanently secured to the corresponding side edge portion 43 by an elongated row of stitching 50.

As disclosed in FIGS. 6–8, the width of the retainer strip 47 is sufficiently greater than the width of the fastener strip 41 and the shoulder strap 11 that both side edge portions 48 and 49 overlap their corresponding side edge portions 43 and 44 of the fabric strip 41. Secured to the top surface of the side edge portion 49 is an elongated attachment strip 52 provided with a plurality of projecting monofilament loop pile elements 53. As disclosed in FIG. 8, the strip 52, although lying on the top surface of the side edge portion 49 in an extended open position, will actually be on the bottom surface of the overturned or overlying side edge portion 49 so that the loop pile elements 53 will cooperate with the hook elements 45 along the one side edge portion 44 of the fabric strip 41.

The function of the fastener device 40 is the same as the fastener device 10. The securing strip 52 permits the opposing second side edge portions 44 and 49 of the respective fabric strip 41 and the retainer strip 47 to be connected to each other in an operative position for enclosing and securing the garment strap 11, yet are readily detachable to permit the garment strap 11 to be removed from or inserted into the fastener device 40 edgewise. The securing strip 52 may be secured to the side edge portion 49 by a row of stitching 54, if desired.

If desired, the retainer strip 47 may be of an elastic fabric material so that it may be stretched upward and over the fabric strip 41, if necessary, or if the shoulder strap 11 varies in width from one foundation garment to another. The retainer strip 47 may be made of an elastic lace of soft material which will fit comfortably upon the shoulder of the wearer 14.

Figure 9:
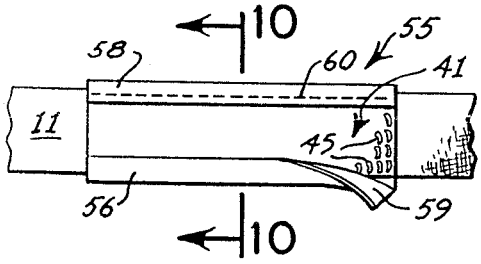
FIG. 9 is a top plan view of a third embodiment of the invention mounted upon a shoulder strap shown fragmentarily, with one end portion of the retainer strip detached.
Figure 10:
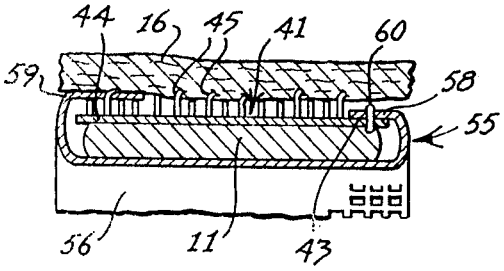
FIG. 10 is an enlarged fragmentary section taken along the line 10—10 of FIG. 9, with the overlying portion of the outer garment included.

In the third embodiment of the invention disclosed in FIGS. 9 and 10, the fastener device 55 includes the identical fastener strip 41 including its top surface 42, side edge portions 43 and 44, and hook elements 45. The retainer strip 56 is the same as the retainer strip 47, except that the securing strip 52 is eliminated. The retainer strip 56 has the same side edge portions 58 and 59 as the side edge portions 48 and 49, and the side edge portion 58 is secured by a row of stitching 60 to the side edge portion 43, in the same manner as the fastener device 40 disclosed in FIGS. 6–8.

However, the fastener device 55 includes its retainer strip 56 of a fibrous material in which the fibers themselves will cooperate and be caught by the hook elements 45 of the fastener strip 41, as illustrated in FIG. 10.

In the fourth embodiment of the invention, the fastener device 65 incorporates the same fastener strip 41 having the same top surface 42, side edge portions 43 and 44, and hook elements 45 as the fastener devices 40 and 55. Moreover, the fastener device 65 has the same retainer strip 56 as the fastener device 55, except the side edge portion 58 is not permanently stitched to the corresponding side edge portion 43 of the fastener strip 41. The side edge portion 58 relies upon the fibrous material in the retainer strip 56 to be secured to the side edge portion 43. In other words, the opposite side edge portions 58 and 59 of the retainer strip 56 in the fastener device 65 of FIGS. 11 and 12, are both secured by the fibrous entanglement of the surfaces of their opposite edge portions with the hook elements 45 along the corresponding first and second side edge portions 43 and 44 of the fastener strip 41.

Figure 11:
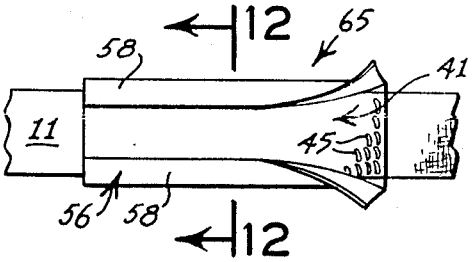
FIG. 11 is a top plan view of a fourth embodiment of the fastener device mounted upon a shoulder strap, shown fragmentarily, with portions of both side edge portions of the detachable retainer strip detached.
Figure 12:
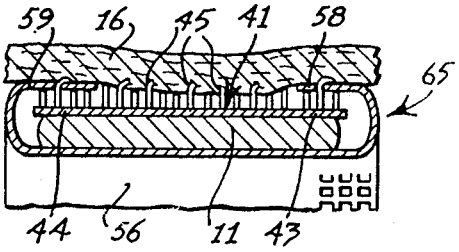
FIG. 12 is an enlarged fragmentary section taken along the line 12—12 of FIG. 11, with the overlying portion of the outer garment included.
Figure 13:
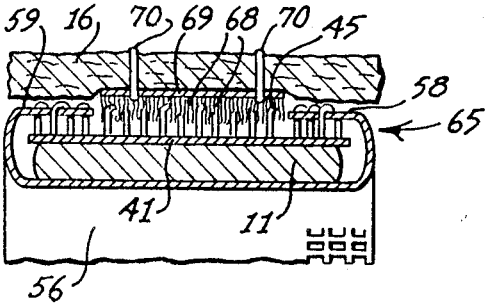
FIG. 13 is a fragmentary sectional view of the fastener device of FIG. 12 in which a garment attachment strip is secured to the bottom surface of the overlying garment and provided with monofilament loop elements for cooperation with the monofilament hook elements of the fastener device.

FIG. 13 merely discloses a fastener device 65 identical to that disclosed in FIGS. 11 and 12 in which its hook elements 45 cooperate with a plurality of monofilament loop elements 68 projecting downward from a garment fastener strip 69 secured to the shoulder portion 16 of the garment 15 by stitching 70. The fabric strip 69 is similar in structure and function to that disclosed in FIGS. 8 and 9 of the copending U.S. Pat. No. 4,704,745.

Although each of the fastener strips and retainer strips incorporated in the above-described four embodiments of the fastener attachments or devices 10, 40, 55, and 65 form sleeve members adapted to slidably receive the shoulder strap 11, nevertheless, each sleeve member could be snugly mounted on the shoulder strap without sliding. However, it is preferred that each of the sleeve members embodied in the fastener attachments or devices 10, 40, 55, and 65 preferably slide to permit proper adjustment of the fastener devices upon the shoulder strap 11 of various sizes of foundation garments and for various wearers. The preferred position of each of the fastener devices upon its corresponding shoulder strap 11 is on top of the shoulder of the wearer and immediately beneath, engaging and supporting, the underlying surface of the corresponding shoulder portion 16 of the outer garment 15.

In a preferred form of the invention, the bottom surface of each retainer strip 27, 47, and 56 is covered with or formed of a soft fabric material for a comfortable fit upon the shoulder of the wearer 14. As described in connection with the fastener device 40, 55, and 65, the fabric material of the respective retainer strips is a soft fibrous lace material, which may be elastic.

After each of the fastener devices 10, 40, 55, and 65 is mounted upon its respective shoulder strap 11 in operative position upon the top of the shoulder of the wearer 14, the upper projecting hook elements 25 and 45 will sink into the undersurface 75 (FIG. 2), in order to hold the shoulder portion 16 in place upon and over the shoulder strap 11. Thus, any tendency of the shoulder portion 16 of the outer garment 15 to slip, slide, or shift laterally outwardly from the wearer's neck and to expose the shoulder strap 11, will be prevented.

All of the fastener attachments or devices 10, 40, 55 and 65 have been found to be quite satisfactory for use on the shoulder straps 11 of brassieres 12, because they may be easily assembled upon existing shoulder straps, as an aftermarket item; may be easily positioned for adjustment for various sizes of wearers, brassieres, and outer garments; and may be easily and quickly removed from the shoulder strap of one brassiere and assembled upon the shoulder strap of another brassiere or foundation garment. By quickly detaching the opposed secured side edge portions on the same side of the sleeve member, each fastener device may be slipped sideways from the shoulder strap 11, and another fastener device slipped sideways over the shoulder strap to sandwich the shoulder strap between the fastener strip and the corresponding retainer strip. The opposed free second side edge portions of the corresponding fastener strip and retainer strip are then pressed together to hold the fastener devices in place upon the shoulder straps.

It has been found that the fastener elements 10, 40, 55, and 65 satisfactorily catch or adhere to the undersurface 75 of an outer garment 15 when the outer garment 15 is made of most textile materials. The fastener attachments have successfully adhered to outer garments 15 made of wool, knitted goods of any type material, polyester, rayon, cotton, jersey, and stretchy cotton materials. The fastener strips 10, 40, 55 and 65 do not readily catch or adhere to outer garments 15 made of silk or nonporous cotton, because of their slick or tightly woven fibrous surfaces. In such instances where adherence of the fastener attachments to the outer garments is not satisfactory, a garment attachment strip 69 (FIG. 13) may be secured to the undersurface 75 of the shoulder portion of the outer garment 15.

The garment fastener attachments or devices 10, 40, 55, and 65, made in accordance with this invention, are simply and inexpensively constructed, and may be easily and detachably assembled and mounted upon an existing shoulder strap 11 for a brassiere 12, without any modification of the brassiere, the strap 11, or the outer garment 15.

What is claimed is:

1. A fastener device for securing a longitudinal shoulder strap of a foundation garment to the fibrous undersurface of an overlying fabric outer garment worn by the wearer, comprising:

(a) an elongated fastener strip having a top surface, a bottom surface, and first and second opposed elongated side edge portions, (b) said top surface comprising a plurality of miniature filament hook elements adapted to catch fibers in the undersurface of a fabric outer garment, (c) an elongated lower retainer strip having first and second opposed elongated side edge portions, (d) first securing means connecting said first side edge portions together, (e) second securing means detachably connecting said second elongated side edge portions together, (f) said fastener strip and said lower retainer strip defining an elongated sleeve member when said second securing means connects said second opposed elongated side edge portions together for receiving a longitudinal shoulder strap of a foundation garment within said sleeve member so that said filament hook elements will catch the loose filaments in the undersurface of a fabric outer garment overlying said shoulder strap on the shoulder of the wearer of said foundation garment and said outer garment to conceal said shoulder strap beneath said outer garment, (g) said second securing means being manually, quickly detachable for separating said opposed second side edge portions for insertion and removal of the shoulder strap between said fastener strip and retainer strip.

2. The invention according to claim 1 in which said first securing means comprises stitch means.

3. The invention according to claim 2 in which said second securing means comprises securing strips attached to and projecting transversely respectively from said second elongated side portions away from said first elongated side edge portions, said securing strips having opposing securing surfaces containing means for detachably connecting said securing surfaces.

4. The invention according to claim 3 in which said means for detachably securing said securing surfaces comprises miniature filament hook elements on one of said surfaces and miniature filament loop elements on said opposing surface for cooperating with said hook elements.

5. The invention according to claim 2 in which said second securing means comprises an elongated securing strip attached to said second elongated side edge portion of said retainer strip and adapted to overlap said top surface of said fastener strip, said securing strip having a plurality of miniature filament loop elements adapted to detachable cooperate with said miniature hook elements of said top surface, along said second elongated side edge portion of said fastener strip to detachably connect said second elongated side edge portions together.

6. The invention according to claim 2 in which said second elongated side edge portion of said retainer strip is wider than said fastener strip to provide an elongated securing strip adapted to wrap over the top surface of said fastener strip, said retainer strip being made of a fabric material having a fibrous surface adapted to be caught by the miniature filament hook elements in said top surface of said fastener strip when said securing strip is wrapped around said second side edge portion of said fastener strip.

7. The invention according to claim 6 in which said fabric material of said retainer strip is elastic.

8. The invention according to claim 1 in which said first securing means detachably connects said first side edge portions together, whereby either or both said first and second securing means may detachably connect said corresponding first and second side edge portions for insertion or removal of the shoulder strap between said fastener strip and said retainer strip.

9. The invention according to claim 8 in which said first and second side edge portions of said retainer strip project laterally beyond the corresponding side edge portions of said fastener strip so that said first and second side edge portions of said retainer strip may wrap around the corresponding side edge portions of said fastener strip, said retainer strip being made of a fabric material having a fibrous surface capable of detachably cooperating with said miniature filament hook elements of said top surface along said side edge portions of said fastener strip to form said sleeve member.

10. The invention according to claim 8 in which said material is elastic.

* * * * *